US011835236B1

(12) United States Patent
Nath et al.

(10) Patent No.: US 11,835,236 B1
(45) Date of Patent: Dec. 5, 2023

(54) COMBUSTOR WITH REVERSE DILUTION AIR INTRODUCTION

(71) Applicant: General Electric Company, Schenectady, NY (US)

(72) Inventors: Hiranya Kumar Nath, Bengaluru (IN); Ravindra Shankar Ganiger, Bengaluru (IN); Steven Clayton Vise, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/857,657

(22) Filed: Jul. 5, 2022

(51) Int. Cl.
*F23R 3/54* (2006.01)
*F23R 3/00* (2006.01)
*F23R 3/06* (2006.01)

(52) U.S. Cl.
CPC ..... *F23R 3/54* (2013.01); *F23R 3/002* (2013.01); *F23R 3/06* (2013.01); *F05D 2240/35* (2013.01)

(58) Field of Classification Search
CPC ..... F05D 2260/963; F23R 3/002; F23R 3/02; F23R 3/06; F23R 3/44; F23R 3/46; F23R 3/50; F23R 3/52; F23R 3/54; F23R 2900/00014; F23R 2900/03041; F23R 2900/03042
See application file for complete search history.

(56) References Cited

U.S. PATENT DOCUMENTS

| | | | | |
|---|---|---|---|---|
| 3,134,229 | A * | 5/1964 | Johnson | F23R 3/045 60/749 |
| 3,352,106 | A * | 11/1967 | Pianko | F23R 3/04 60/758 |
| 3,451,216 | A * | 6/1969 | Harding | F23R 3/06 431/185 |
| 3,958,416 | A | 5/1976 | Hammond, Jr. et al. | |
| 4,211,073 | A * | 7/1980 | Guillot | F23R 3/04 60/746 |
| 4,301,657 | A * | 11/1981 | Penny | F23R 3/12 60/750 |
| 4,420,929 | A | 12/1983 | Jorgensen et al. | |
| 4,787,208 | A | 11/1988 | DeCorso | |
| 4,930,725 | A | 6/1990 | Thompson et al. | |
| 4,982,570 | A | 1/1991 | Waslo et al. | |
| 5,052,176 | A | 10/1991 | Labatut et al. | |
| 5,117,636 | A | 6/1992 | Bechtel, II et al. | |
| 5,127,221 | A | 7/1992 | Beebe | |
| 5,207,054 | A | 5/1993 | Rodgers et al. | |
| 5,303,554 | A | 4/1994 | Faulkner | |
| 6,427,446 | B1 | 8/2002 | Kraft et al. | |
| 6,655,147 | B2 | 12/2003 | Farmer et al. | |

(Continued)

FOREIGN PATENT DOCUMENTS

EP 3486569 B1 1/2022

*Primary Examiner* — Scott J Walthour
(74) *Attorney, Agent, or Firm* — Dority & Manning, P.A.

(57) ABSTRACT

A combustor for a gas turbine engine includes a forward liner segment having an aft end portion. The forward liner segment at least partially defines a primary combustion chamber. The combustor further includes an aft liner segment having a forward end portion. A channel is defined between the forward liner segment and the aft liner segment. The channel directs a stream of dilution air in a counter-flow or reverse direction with respect to combustion gases flowing from the primary combustion chamber during operation of the combustor.

18 Claims, 6 Drawing Sheets

(56) References Cited

U.S. PATENT DOCUMENTS

| | | | | |
|---|---|---|---|---|
| 6,772,595 | B2 | 8/2004 | Martling et al. | |
| 6,865,892 | B2 | 3/2005 | Garrido et al. | |
| 7,389,643 | B2 | 6/2008 | Simons et al. | |
| 7,500,347 | B2 | 3/2009 | Sanders et al. | |
| 7,712,314 | B1 | 5/2010 | Barnes et al. | |
| 8,484,980 | B1 | 7/2013 | Trefny et al. | |
| 8,646,277 | B2 | 2/2014 | Chila et al. | |
| 8,966,877 | B2 | 3/2015 | McKinney | |
| 9,546,598 | B2 | 1/2017 | Ostebee et al. | |
| 9,689,572 | B2 | 6/2017 | Johnson et al. | |
| 9,976,744 | B2 | 5/2018 | Wood et al. | |
| 10,151,487 | B2 | 12/2018 | Duesing et al. | |
| 10,422,283 | B2 | 9/2019 | Yang et al. | |
| 10,865,987 | B2 | 12/2020 | Syed et al. | |
| 10,920,985 | B2 | 2/2021 | Gao et al. | |
| 2009/0019854 | A1 | 1/2009 | Simons et al. | |
| 2009/0272121 | A1* | 11/2009 | Youssef | F02C 3/113 60/39.25 |
| 2014/0216038 | A1 | 8/2014 | Keener et al. | |
| 2019/0085767 | A1* | 3/2019 | Vise | F23R 3/002 |
| 2020/0271317 | A1 | 8/2020 | Simmons et al. | |
| 2021/0254550 | A1 | 8/2021 | Kraft | |

* cited by examiner

COMBUSTOR WITH REVERSE DILUTION AIR INTRODUCTION

FIELD

The present disclosure relates to a gas turbine engine combustor with reverse flow dilution air introduction.

BACKGROUND

Gas turbine engines, such as turbofan engines, may be used for aircraft propulsion. A gas turbine engine generally includes a compressor section, a combustion section, and a turbine section. More specifically, the combustion section includes an annular combustor. In some combustor configurations, such as a compact combustor, the formation of NOx (oxides of nitrogen) may be reduced by utilizing a combustion method known as rich-quench-lean or RQL. The inventors of the present disclosure have found that improved mixing of a dilution air with combustion gases flowing from a primary region of combustion in a RQL combustor would be beneficial in the art.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

Figure 1:
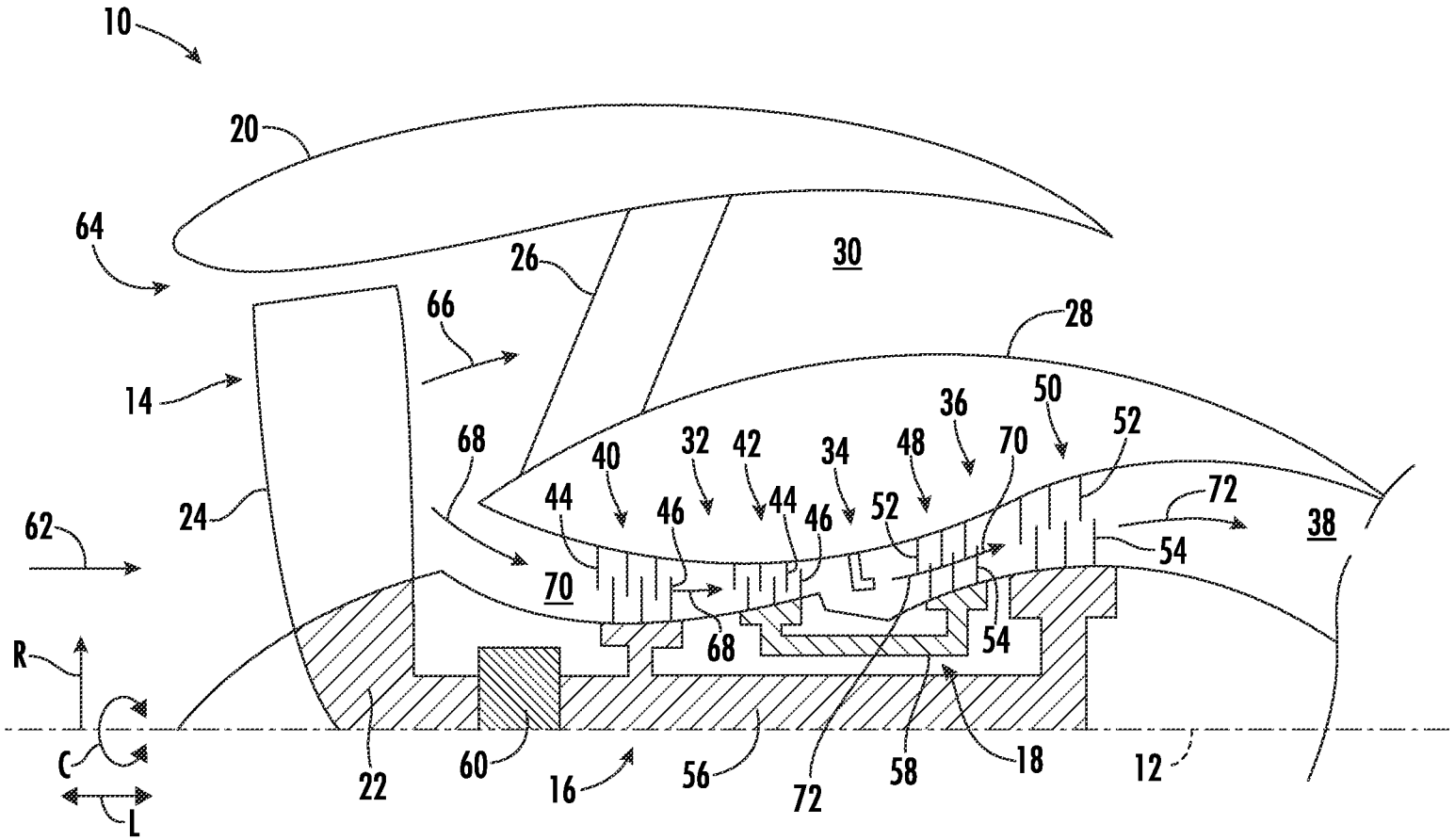
FIG. 1 is a schematic cross-sectional view of a gas turbine engine in accordance with an exemplary embodiment of the present disclosure.

Repeat use of reference characters in the present specification and drawings is intended to represent the same or analogous features or elements of the present disclosure.

DETAILED DESCRIPTION

Reference now will be made in detail to exemplary embodiments of the presently disclosed subject matter, one or more examples of which are illustrated in the drawings. Each example is provided by way of explanation and should not be interpreted as limiting the present disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

As used herein, the terms "first", "second", and "third" may be used interchangeably to distinguish one component from another and are not intended to signify location or importance of the individual components. Furthermore, the terms "upstream" and "downstream" refer to the relative direction with respect to fluid flow in a fluid pathway. For example, "upstream" refers to the direction from which the fluid flows, and "downstream" refers to the direction to which the fluid flows.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary. The singular forms "a", "an", and "the" include plural references unless the context clearly dictates otherwise. The term "at least one of" in the context of, e.g., "at least one of A, B, and C" refers to only A, only B, only C, or any combination of A, B, and C.

The present disclosure is generally related to a combustor liner design for improved emissions reduction. A compact combustor configuration known as a rich-quench-lean (RQL) combustor is used in the gas turbine industry, particularly in the aircraft gas turbine industry, to reduce the formation of NOx (oxides of nitrogen) emissions. In an RQL combustor, a fuel-rich fuel-air mixture is supplied to a primary combustion chamber for combustion therein. Because the fuel-air mixture is fuel-rich, not all the fuel is combusted in the primary combustion chamber. To burn the remaining fuel in the combustion gases, cooler dilution air is introduced into the flow of the combustion gases. This dilution air quickly cools (quenches) the combustion gases, thereby reducing the formation of NOx, and mixes with those gases to add additional oxygen which provides a lean fuel-air mixture to a secondary combustion chamber to complete the combustion process rapidly, thereby further reducing NOx (oxides of nitrogen) and other non-preferred emissions. Although RQL combustors are useful for reducing emissions, further reduction of emission gases, particularly NOx is desired.

The combustion liner design disclosed herein, provides a new architecture of a compact RQL combustor for improved control of operability and NOx requirements for compact combustors. In at least one embodiment, the combustor includes a forward liner segment defining a primary combustion chamber and an aft liner segment defining a secondary combustion chamber downstream of the primary combustion chamber. The primary combustion chamber has a relatively larger volume than the secondary combustion chamber. The higher primary combustion chamber volume provides for improved operability and the smaller secondary combustion chamber accelerates flow for more rapid mixing/quenching. Channels defined between the forward liner segment and the aft liner segment are oriented to provide a stream of dilution air that is counter to or nearly opposite to the flow of the combustion gases flowing from the primary combustion chamber. This channel orientation/reverse-flow entry of dilution flow results in greater turbulence within the combustion gases upstream from the secondary combustion chamber, thereby resulting in more complete/thorough mixing of the dilution air and the combustion gases. This effect results in greater NOx reduction than a known RQL combustor.

Referring now to the drawings, FIG. 1 is a schematic cross-sectional view of one embodiment of a gas turbine engine 10. As shown in FIG. 1, the gas turbine engine 10 defines a longitudinal direction L, a radial direction R, and a circumferential direction C. The longitudinal direction L extends parallel to a longitudinal centerline 12 of the gas turbine engine 10, the radial direction R extends orthogonally outward from the longitudinal centerline 12, and the circumferential direction C extends generally concentrically around the longitudinal centerline 12.

In general, the gas turbine engine 10 includes a fan 14, a low-pressure (LP) spool 16, and a high pressure (HP) spool 18 at least partially encased by an annular nacelle 20. More specifically, the fan 14 includes a fan rotor 22 and a plurality of fan blades 24 (one is shown) coupled to the fan rotor 22. In this respect, the fan blades 24 are spaced apart from each other along the circumferential direction C and extend outward from the fan rotor 22 along the radial direction R. Moreover, the LP and HP spools 16, 18 are positioned downstream from the fan 14 along the longitudinal centerline 12 (i.e., in the longitudinal direction L). As shown, the LP spool 16 is rotatably coupled to the fan rotor 22, thereby permitting the LP spool 16 to rotate the fan 14. Additionally, a plurality of outlet guide vanes or struts 26 spaced apart from each other in the circumferential direction C extend between an outer casing 28 surrounding the LP and HP spools 16, 18 and the nacelle 20 along the radial direction R. As such, the struts 26 support the nacelle 20 relative to the outer casing 28 such that the outer casing 28 and the nacelle 20 define a bypass airflow passage 30 positioned therebetween.

The outer casing 28 generally surrounds or encases, in serial flow order, a compressor section 32, a combustion section 34, a turbine section 36, and an exhaust section 38. The compressor section 32 may include a low-pressure (LP) compressor 40 of the LP spool 16 and a high-pressure (HP) compressor 42 of the HP spool 18 positioned downstream from the LP compressor 40 along the longitudinal centerline 12. Each compressor 40, 42 may, in turn, include one or more rows of stator vanes 44 interdigitated with one or more rows of compressor rotor blades 46. Moreover, in some embodiments, the turbine section 36 includes a high-pressure (HP) turbine 48 of the HP spool 18 and a low-pressure (LP) turbine 50 of the LP spool 16 positioned downstream from the HP turbine 48 along the longitudinal centerline 12. Each turbine 48, 50 may, in turn, include one or more rows of stator vanes 52 interdigitated with one or more rows of turbine rotor blades 54. In a particular embodiment, the turbine section 36 includes a first stator vane or turbine nozzle 52 positioned downstream of the combustion section 34 and upstream of the turbine rotor blades 54.

Additionally, the LP spool 16 includes a low-pressure (LP) shaft 56 and the HP spool 18 includes a high pressure (HP) shaft 58 positioned concentrically around the LP shaft 56. In such embodiments, the HP shaft 58 rotatably couples the rotor blades 54 of the HP turbine 48 and the rotor blades 46 of the HP compressor 42 such that rotation of the HP turbine rotor blades 54 rotatably drives HP compressor rotor blades 46. As shown, the LP shaft 56 is directly coupled to the rotor blades 54 of the LP turbine 50 and the rotor blades 46 of the LP compressor 40. Furthermore, the LP shaft 56 is coupled to the fan 14 via a gearbox 60. In this respect, the rotation of the LP turbine rotor blades 54 rotatably drives the LP compressor rotor blades 46 and the fan blades 24.

In certain embodiments, the gas turbine engine 10 may generate thrust to propel an aircraft. More specifically, during operation, air 62 enters an inlet portion 64 of the gas turbine engine 10. As the air 62 flows past the fan 14, the air 62 is split into bypass air 66 (indicated by arrow 66) and compressor air 68 (indicated by arrow 68). The bypass air 66 is directed through the bypass airflow passage 30. The compressor air 68 is guided to an inlet 70 of the LP compressor 40 wherein the rotor blades 46 progressively compress the compressor air 68. The compressor air 68 is then guided to the HP compressor 42 in which the rotor blades 46 therein continue progressively compressing the compressor air 68. The compressed compressor air 68 is subsequently delivered to the combustion section 34. Portions of the compressor air 68 may be extracted from the HP compressor 42 for cooling and/or other operational purposes.

In the combustion section 34, the compressed compressor air 68 mixes with fuel and burns to generate high-temperature and high-pressure combustion gases 72. Thereafter, the combustion gases 72 flow through the HP turbine 48 where the HP turbine rotor blades 54 extract a first portion of kinetic and/or thermal energy therefrom. This energy extraction rotates the HP shaft 58, thereby driving the HP compressor 42. The combustion gases 72 then flow through the LP turbine 50 in which the LP turbine rotor blades 54 extract a second portion of kinetic and/or thermal energy therefrom. This energy extraction rotates the LP shaft 56, thereby driving the LP compressor 40 and the fan 14 via the gearbox 60. The combustion gases 72 then exit the gas turbine engine 10 through the exhaust section 38.

The configuration of the gas turbine engine 10 described above and shown in FIG. 1 is provided only to place the present subject matter in an exemplary field of use. Thus, the present subject matter may be readily adaptable to any manner of gas turbine engine configuration, including other types of aviation-based gas turbine engines, marine-based gas turbine engines, and/or land-based/industrial gas turbine engines.

Figure 2:
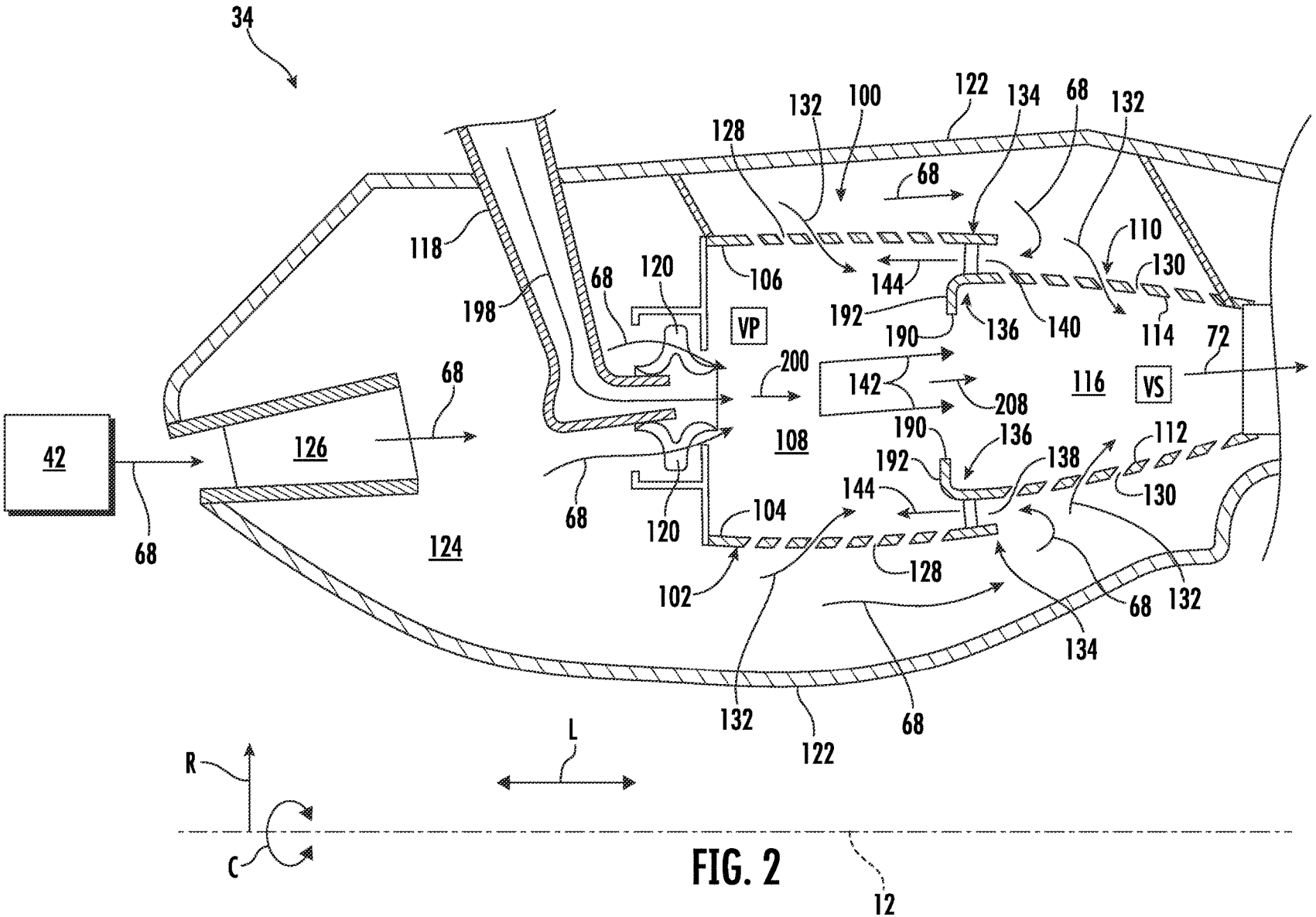
FIG. 2 is a cross-sectional side view of a combustion section of a gas turbine engine in accordance with an exemplary embodiment of the present disclosure.

FIG. 2 is a cross-sectional side view of the combustion section 34 of the gas turbine engine 10 in accordance with an exemplary embodiment of the present disclosure. As shown in FIG. 2, the combustion section 34 includes an annular combustor 100. The annular combustor 100, in turn, includes a forward liner segment 102 having a forward inner liner 104 and a forward outer liner 106. The forward outer liner 106 is radially spaced in the radial direction R from the forward inner liner 104. A first or primary combustion chamber 108 is defined between the forward inner liner 104 and the forward outer liner 106.

It should be appreciated that the exemplary gas turbine engine 10 depicted in FIG. 1 is provided by way of example only, and that in other exemplary embodiments, the gas turbine engine 10 may have other configurations. For example, in other exemplary embodiments, aspects of the present disclosure may (as appropriate) be incorporated into, e.g., a turboprop gas turbine engine, a turboshaft gas turbine engine, or a turbojet gas turbine engine. The various features of the combustor 100 disclosed herein may be incorporated in other combustions systems or configurations such as a reverse flow RQL combustor.

The combustor 100 further includes an aft liner segment 110 formed by aft inner liner 112 and aft outer liner 114. The aft inner liner 112 and aft outer liner 114 are radially spaced apart in the radial direction R. A secondary combustion chamber 116 is defined between the aft inner liner 112 and the aft outer liner 114. The aft liner segment 110 is positioned downstream of the forward liner segment 102 relative to the direction of flow of the combustion gases 72 through the combustor 100.

As shown in FIG. 2, the combustor 100 includes one or more fuel nozzles 118. Although FIG. 2 illustrates a single fuel nozzle 118, the combustion section 34 generally includes a plurality of fuel nozzles 118 circumferentially spaced in an annular array about the longitudinal centerline 12 of the gas turbine engine 10. In particular embodiments, the combustor 100 includes swirlers or vanes 120 disposed upstream from the primary combustion chamber 108.

A compressor discharge casing 122 at least partially forms a compressor discharge plenum 124. The compressor discharge casing 122 at least partially surrounds or otherwise encloses the annular combustor 100 in the circumferential direction C. The annular combustor 100 is in fluid communication with the compressor discharge plenum 124. One or more guide vanes 126 and a diffuser may be used to direct the flow of compressed compressor air 68 from the HP compressor 42 into the compressor discharge plenum 124.

In various embodiments, the forward liner segment 102 includes at least one cooling hole or aperture 128 that is in fluid communication with the compressor discharge plenum 124. In addition, or in the alternative, the aft liner segment 110 includes at least one cooling hole or aperture 130 that is in fluid communication with the compressor discharge plenum 124. Cooling aperture(s) 128 allow a second portion of the compressor air 68, herein referred to as cooling air and indicated by arrow 132, to pass through the respective forward inner liner 104 or forward outer liner 106 and to enter the primary combustion chamber 108 during operation. The air may form a cooling boundary layer along inner surface(s) of the respective forward inner liner 104 and forward outer liner 106. In addition, or in the alternative, cooling aperture(s) 130 may allow cooling air 132 to pass through the respective aft inner liner 112 and/or the aft outer liner 114 to form a cooling boundary layer(s) along inner surface(s) of the respective aft inner liner 112 and aft outer liner 114 during operation.

In various embodiments of the present disclosure, an aft end portion 134 of the forward liner segment 102 overlaps a forward end portion 136 of the aft liner segment 110, thereby forming an inner gap or channel 138 and an outer gap or channel 140 therebetween. In certain embodiments, the forward end portion 136 of the aft liner segment 110 is at least partially disposed within the aft end portion 134 of the forward liner segment 102, thereby forming the inner channel 138 and the outer channel 140 therebetween. In certain embodiments, as shown in FIG. 2, the inner channel 138 and the outer channel 140 extend in or at least nearly parallel to the longitudinal direction L.

Unlike the cooling apertures 128, 130 which direct cooling air 132 in a generally parallel or downstream manner with respect to a flow of combustion gases 142, the inner channel 138 and the outer channel 140 are oriented to direct, inject or stream a portion of compressor air 68 herein referred to as dilution air 144, in a generally longitudinal L (counter-flow/upstream flow/opposite flow) direction with respect to combustion gases 142 flowing from the primary combustion chamber 108 towards the secondary combustion chamber 116. This relative orientation of the stream of dilution air 144 with respect to the combustion gases 142 facilitates more complete mixing between the combustion gases 142 and the dilution air 144. In addition, this configuration provides for a more stable combustion process with a larger volume VP for the primary combustion chamber and a smaller volume VS of the secondary combustion chamber 116 results in shorter residence time, thereby reducing NOR.

Figure 3:
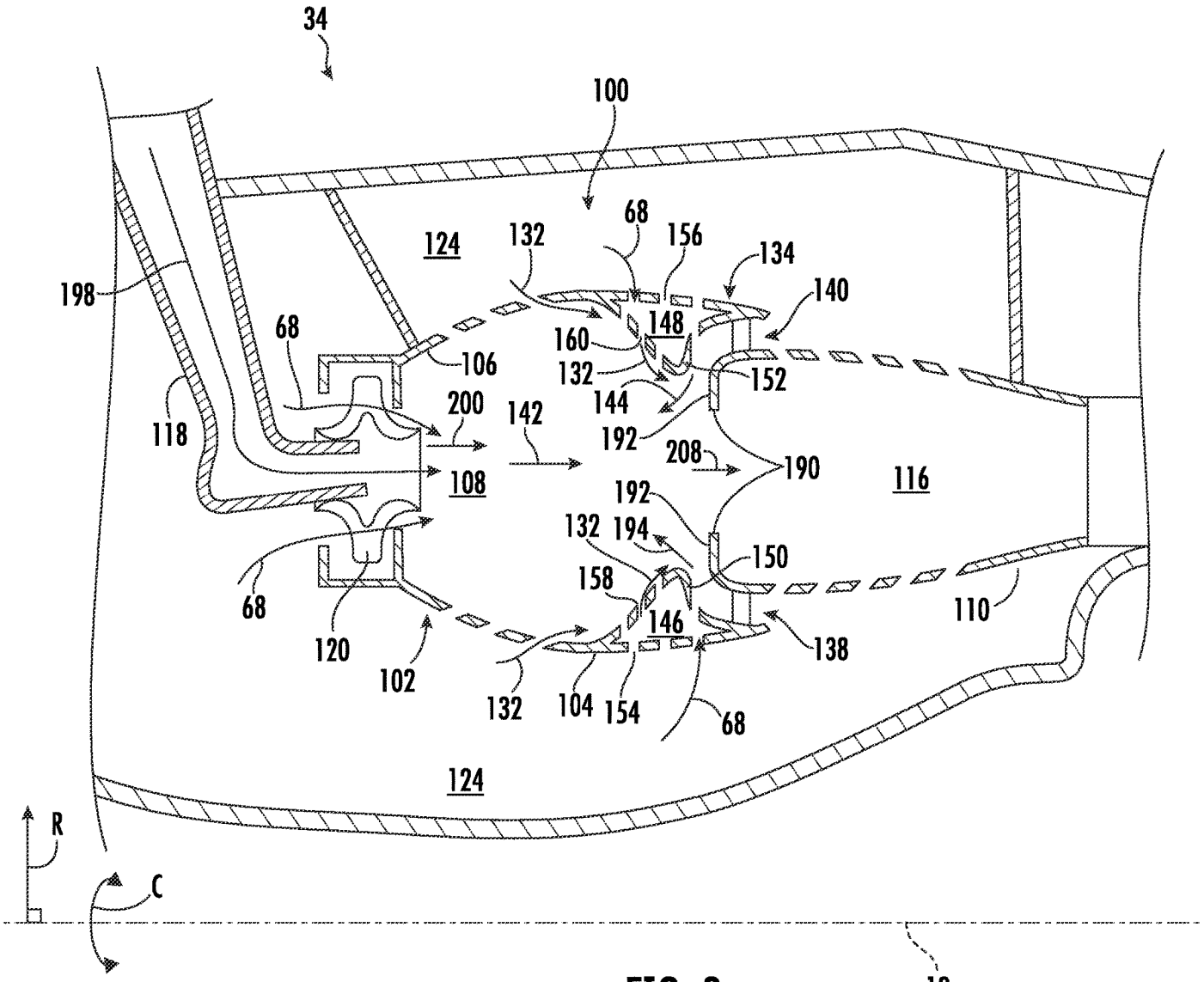
FIG. 3 is a cross-sectional side view of a combustion section of a gas turbine engine in accordance with an exemplary embodiment of the present disclosure.

FIG. 3 is a cross-sectional side view of the combustion section 34 of the gas turbine engine 10 in accordance with an alternate embodiment of the present disclosure. In certain embodiments, as shown in FIG. 3, the aft end portion 134 of the forward liner segment 102 may include one or more pockets or damping chambers 146, 148. Damping chambers 146, 148 may be formed along the forward inner liner 104 and the forward outer liner 106 respectively, downstream from the fuel nozzle 118 and upstream from the aft liner segment 110. An inner wall 150 of damping chamber 146 may at least partially define inner channel 138. An inner wall 152 of damping chamber 148 may at least partially define outer channel 140. In certain embodiments, one or more inlet apertures 154, 156 may provide for fluid communication between the compressor discharge plenum 124 and the damping chambers 146, 148 respectively.

In certain embodiments, as shown in FIG. 3, one or more exhaust apertures 158, 160 may be defined along inner walls 150, 152 respectively. At least one of exhaust apertures 158, 160 may be formed/angled/oriented radially inwardly or radially outwardly with respect to the longitudinal centerline 12 of the gas turbine engine 10 to direct a portion/stream of the cooling air 132 along inner walls 150, 152 to provide film cooling to the forward liner segment 102 during operation of the combustor 100. In particular embodiments, damping chambers 146, 148 perform as Helmholtz resonators to dampen thermal and/or acoustic oscillations emanating from the combustor 100 during operation.

Figure 4:
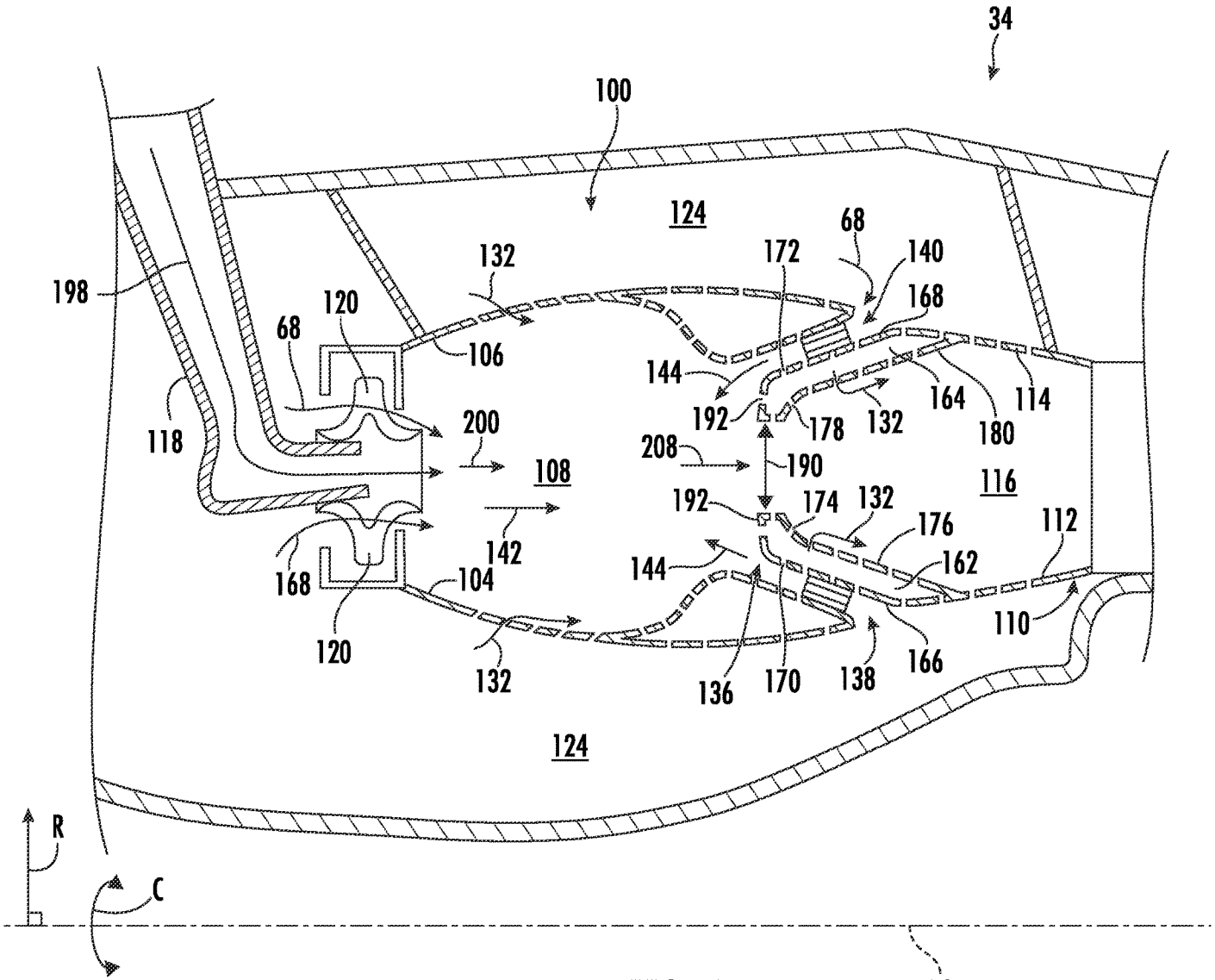
FIG. 4 is a cross-sectional side view of a combustion section of a gas turbine engine in accordance with an exemplary embodiment of the present disclosure.

FIG. 4 is a cross-sectional side view of the combustion section 34 of the gas turbine engine 10 shown in FIG. 1, in accordance with an alternative embodiment of the present disclosure. In certain embodiments, as shown in FIG. 4, the forward end portion 136 of the aft liner segment 110 may include one or more pockets or damping chambers 162, 164. This may be in addition to or in the alternative to the damping chambers 146, 148 of the forward liner segment 102 as seen in FIG. 3. Damping chambers 162, 164 may be formed along the aft inner liner 112 and the aft outer liner 114 respectively, downstream from the primary combustion chamber 108. An outer wall 166 of damping chamber 162 may at least partially define inner channel 138. An outer wall 168 of damping chamber 164 may at least partially define outer channel 140. In certain embodiments, one or more inlet apertures 170, 172 may provide for fluid communication between the compressor discharge plenum 124 and the damping chambers 162, 164 respectively.

In certain embodiments, one or more exhaust apertures 174 may be defined along an inner wall 176 of the aft inner liner 112. In addition, or in the alternative, one or more exhaust apertures 178 may be defined along an inner wall 180 of the aft outer liner 114. Exhaust apertures 174, 178 may be formed/angled/oriented radially inwardly or radially outwardly with respect to the longitudinal centerline 12 of the gas turbine engine 10 to direct a portion/stream of the cooling air 132 along inner walls 176, 180 to provide film cooling to the aft liner segment 110 during operation of the combustor 100. In particular embodiments, damping chambers 162, 164 perform as Helmholtz resonators to dampen thermal and/or acoustic oscillations emanating from the combustor 100 during operation. In certain embodiments, the damping chambers 162, 164 may perform as mechanical box stiffeners to lower thermal distortion/deformation.

Figure 5:
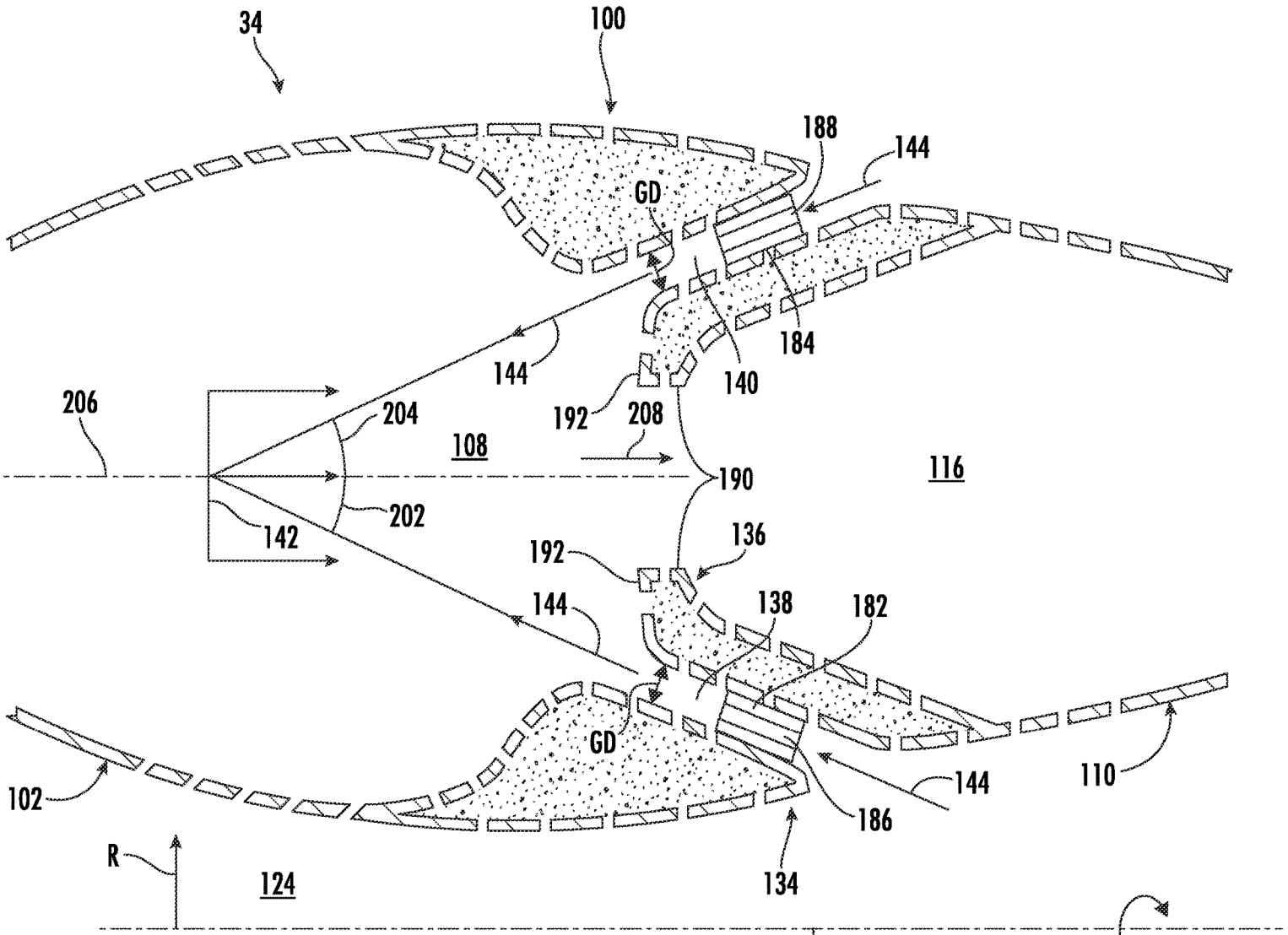
FIG. 5 is an enlarged cross-sectional side view of a combustion section of a gas turbine engine in accordance with an exemplary embodiment of the present disclosure.

FIG. 5 is an enlarged cross-sectional side view of a portion of the combustor 100 of the gas turbine engine 10 as shown in FIG. 4, in accordance with an exemplary embodiment of the present disclosure. As shown in FIG. 5, a preferred radial gap distance GD may be maintained between the aft end portion 134 of the forward liner segment 102 and the forward end portion 136 of the aft liner segment 110 via mechanical spacers or inserts 182, 184 disposed within the respective inner channel 138 and outer channel 140.

The inserts 182, 184 may be circumferentially spaced apart in direction C at specific distances to meter the flow of the dilution air 144 flowing through the respective inner channel 138 and outer channel 140 and into the flow of combustion gases 142. The inserts 182, 184 may be configured to allow for axial and/or radial relative movement and thermal growth between the aft end portion 134 of the forward liner segment 102 and the forward end portion 136 of the aft liner segment 110. The inserts 182, 184 may be rigidly connected to or slidingly engaged with the forward liner segment 102 and/or the aft liner segment 110. The inserts 182, 184 may include or at least partially define apertures 186, 188. The apertures may be sized to meter the flow of the dilution air 144 flowing through the respective inner channel 138 and outer channel 140 and into the flow of combustion gases 142.

In various embodiments, as shown in FIGS. 2, 3, 4, and 5 collectively, an inlet section or opening 190 to the aft liner segment 110 includes a projection portion or fence 192. More specifically, the fence 192 extends radially with respect to radial direction R into the flow of combustion gases 142, thus narrowing the opening 190 to the secondary combustion chamber 116. As such, the fence 192 increases turbulence of the combustion gases 142 as they flow from the primary combustion chamber 108 and into the secondary combustion chamber 116, thereby promoting quicker and more uniform mixing of the dilution air 144.

Figure 6:
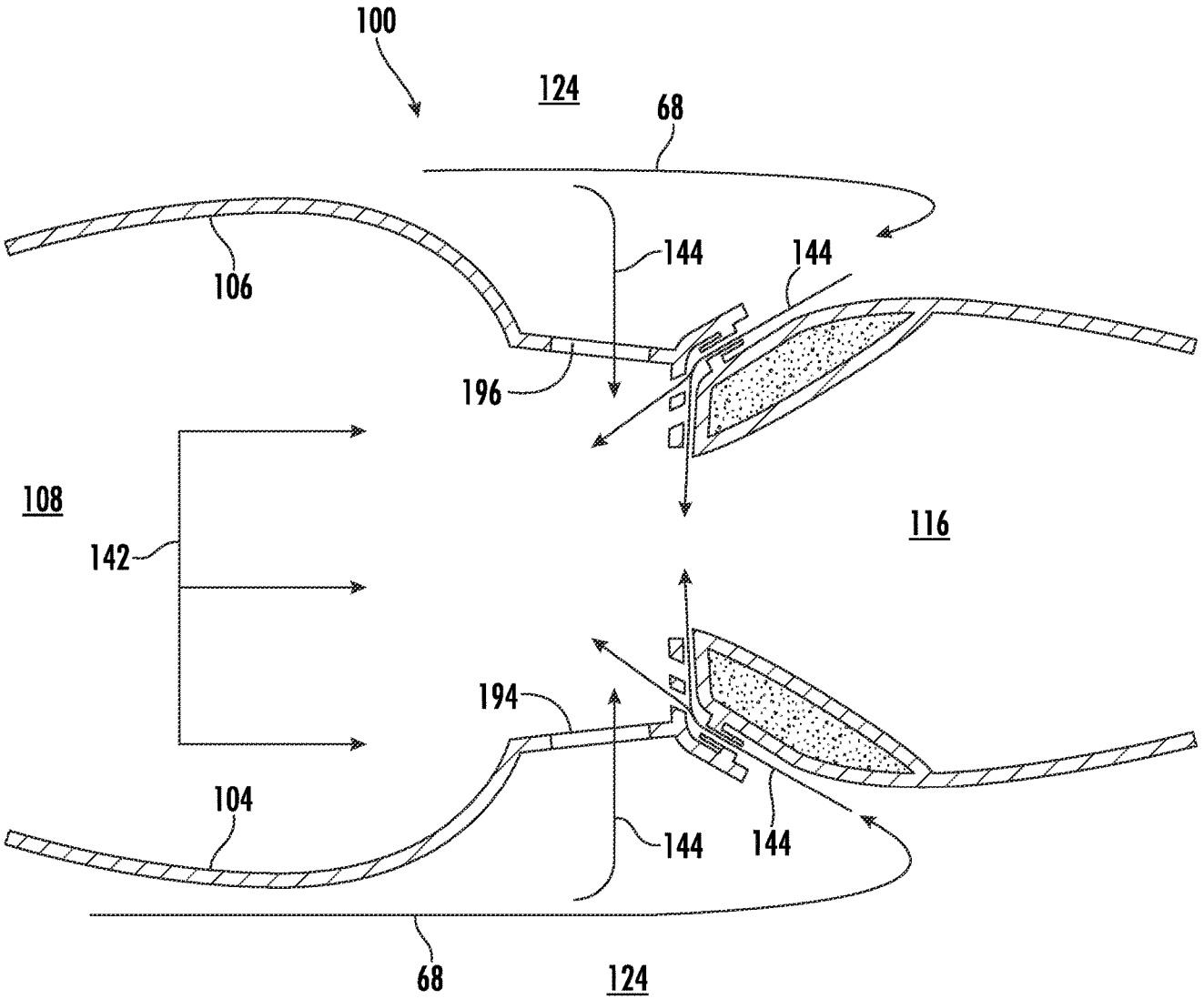
FIG. 6 is an enlarged cross-sectional side view of a portion of the combustion section of the gas turbine engine, in accordance with an exemplary embodiment of the present disclosure.

FIG. 6 is an enlarged cross-sectional side view of a portion of the combustor 100 of the gas turbine engine 10 as shown in FIG. 1, in accordance with an alternative embodiment of the present disclosure. In one embodiment, at least one of the forward inner liner 104 and the forward outer liner 106 includes/defines at least one forward discrete dilution hole(s) 194, 196. The forward discrete dilution hole(s) 194, 196 is in fluid communication with the compressor discharge plenum 124 and the primary combustion chamber 108 and provides an annular sheet of dilution air 144 which may also serve to cool or quench the combustion gases 142 upstream from the secondary combustion chamber 116.

In operation, as shown in FIGS. 2, 3, and 4 collectively, a portion of the compressor air 68 from the compressor discharge plenum 124 is routed through and/or across the vanes 120 of the fuel nozzle 118 to impart swirl or turbulence to the compressor air 68. This turbulence or swirl enhances mixing with fuel (as indicated by arrow 198) from the respective fuel nozzle 118 upstream from the primary combustion chamber 108. A fuel-rich fuel-and-air mixture 200 flows downstream from the respective fuel nozzle 118 for combustion in the primary combustion chamber 108. Because the fuel-and-air mixture 200 is fuel rich, an incomplete or partial burn of the fuel-and-air mixture 200 occurs in the primary combustion chamber 108. A portion of the compressor air 68 is routed through the cooling apertures 128, 130 as cooling air 132 and forms thermal boundary layers along inner surfaces of the forward inner liner 104 and forward outer liner 106 for film cooling.

As shown in FIG. 5, the dilution air 144 flows through the inner channel 138 and the outer channel 140 via inserts 182, 184, and then mixes with and quenches/cools the combustion gases 142 flowing from the primary combustion chamber 108 upstream from the secondary combustion chamber 116. The orientation of the inner channel 138 and outer channel 140 results in a stream of dilution air 144 that is counter or opposite to the direction of flow of the combustion gases 142 within the primary combustion chamber 108. This relative orientation of the inner channel 138 and outer channel 140 and the streams of dilution air 144 with respect to the combustion gases 142 facilitates more complete mixing between the combustion gases 142 and the dilution air 144 as compared to known dilution air injection methods which generally direct a flow of dilution air perpendicular to or in the same downstream flow direction as the combustion gases 142 flowing through the primary combustion chamber 108 towards the secondary combustion chamber 116. In addition, this configuration allows for a larger volume VP for the primary combustion chamber 108 when compared to a smaller volume VS of the secondary combustion chamber 116 which results in a more stable combustion process, particularly at ground and high-altitude startup, and smaller volume VS of the secondary combustion chamber 116 or region results in shorter residence time thus reducing NOx emissions.

As shown in FIG. 5, the inner channel 138 and outer channel 140 may be set at an angle 202, 204 respectively with respect to an axial centerline 206 of the combustor 100. Angle 202 may range from one degree to ninety degrees. Angle 204 may range from negative one to negative ninety degrees with respect to the axial centerline 206. In particular embodiments, angle 202 may range between 1 degree and 80 degrees. In particular embodiments, angle 202 may range between 1 degree and 70 degrees. In particular embodiments, angle 202 may range between 1 degree and 60 degrees. In particular embodiments, angle 202 may range between 1 degree and 50 degrees. In particular embodiments, angle 202 may range between 1 degree and 45 degrees. In particular embodiments, angle 204 may range between negative 1 degree and negative 80 degrees. In particular embodiments, angle 204 may range between negative 1 degree and negative 70 degrees. In particular embodiments, angle 204 may range between negative 1 degree and negative 60 degrees. In particular embodiments, angle 204 may range between negative 1 degree and negative 50 degrees. In particular embodiments, angle 204 may range between negative 1 degree and 45 degrees.

The combination of mixing the dilution air 144 with the combustion gases 142 and quickly quenching the combustion gases 142 results in a substantial reduction of $NO_x$ formation. In addition to quenching, the dilution air 144 further provides additional oxygen to the combustion gases 142 to mix with unburnt fuel therein. The mixing of the dilution air 144 results in a lean fuel-and-air mixture 208, shown in FIGS. 2, 3, and 4 collectively, to flow from the primary combustion chamber 108 into the secondary combustion chamber 116 to complete the combustion process.

In certain embodiments, as shown in FIG. 3, a portion of the compressed compressor air 68 flows from the compressor discharge plenum 124, through the inlet apertures 154, 156 and into the respective damping chamber 146, 148. This pressurizes the damping chambers 146, 148 and provides cooling to a relative portion the forward inner liner 104 and forward outer liner 106. The compressed compressor air 68 may then flow through one or more exhaust apertures 158, 160 to provide film cooling of the forward inner liner 104 and forward outer liner 106 respectively.

In certain embodiments, as shown in FIG. 3, a portion of the compressed compressor air 68 flows from the compressor discharge plenum 124, through the inlet apertures 154, 156 and into the respective damping chamber 146, 148 of the forward liner segment 102. This pressurizes the corresponding damping chambers 146, 148 and provides film cooling to a relative portion the forward inner liner 104 and forward outer liner 106. The compressed compressor air 68 may then flow through one or more exhaust apertures 158, 160 to provide film cooling to the forward inner liner 104 and forward outer liner 106. In certain embodiments, damping chambers 146, 148 and their respective exhaust apertures 158, 160 are sized and/or shaped to dampen acoustic and/or thermal acoustic oscillations within the combustor 100.

In certain embodiments, as shown in FIG. 4, a portion of the compressed compressor air 68 flows from the compressor discharge plenum 124, through the inlet apertures 170, 172 and into the respective damping chamber 162, 164 of the aft liner segment 110. This pressurizes the corresponding damping chambers 162, 164 and provides cooling to a relative portion the aft inner liner 112 and aft outer liner 114. The compressed compressor air 68 may then flow through one or more exhaust apertures 174, 178 to provide film cooling to the aft inner liner 112 and to the aft outer liner 114 respectively. In certain embodiments, damping chambers 162, 164 and their respective exhaust apertures 174, 178 are sized and/or shaped to dampen acoustic and/or thermal acoustic oscillations within the combustor 100.

Further aspects are provided by the subject matter of the following clauses:

A combustor for a gas turbine engine comprising: a forward liner segment having an aft end portion, wherein the forward liner segment defines a primary combustion chamber; and an aft liner segment having a forward end portion, wherein a channel is defined between the forward liner segment and the aft liner segment, wherein the channel directs a stream of dilution air in a counter-flow direction with respect to combustion gases flowing from the primary combustion chamber during operation of the combustor.

The combustor of the preceding clause, wherein the forward end portion of the aft liner segment is at least partially disposed within the aft end portion of the forward liner segment.

The combustor of any preceding clause, wherein the forward liner segment includes a forward inner liner and a forward outer liner, wherein the forward inner liner at least partially defines a first damping chamber, and the forward outer liner at least partially defines a second damping chamber, wherein the first and second damping chambers are disposed downstream from the primary combustion chamber and upstream from the aft liner segment.

The combustor of any preceding clause, wherein the forward liner segment includes a first damping chamber and second damping chamber disposed downstream from the primary combustion chamber and upstream from the aft liner segment, wherein the forward liner segment further comprises a first plurality of inlet apertures in fluid communication with the first damping chamber and a second plurality of inlet apertures in fluid communication with the second damping chamber.

The combustor of any preceding clause, wherein the forward liner segment includes a first exhaust aperture in fluid communication with the first damping chamber and the primary combustion chamber, and wherein the forward liner segment further includes a second exhaust aperture in fluid communication with the second damping chamber and the primary combustion chamber.

The combustor of any preceding clause, wherein at least one of the first exhaust aperture and the second exhaust aperture directs a stream of cooling air to the forward liner segment during operation of the combustor.

The combustor of any preceding clause, wherein the aft liner segment includes an aft inner liner and an aft outer liner, wherein the aft inner liner at least partially defines a first damping chamber, and the aft outer liner at least partially defines a second damping chamber, wherein the first and second damping chambers are disposed downstream from the primary combustion chamber and upstream from a secondary combustion chamber at least partially defined by the aft liner segment.

The combustor of any preceding clause, wherein the aft liner segment includes a first damping chamber and second damping chamber disposed downstream from the primary combustion chamber and upstream from a secondary combustion chamber at least partially defined by the aft liner segment, wherein the aft liner segment further comprises a first plurality of inlet apertures in fluid communication with the first damping chamber and a second plurality of inlet apertures in fluid communication with the second damping chamber.

The combustor of any preceding clause, wherein the aft liner segment includes a first exhaust aperture in fluid communication with the first damping chamber, and wherein the aft liner segment includes a second exhaust aperture in fluid communication with the second damping chamber, wherein the first and second exhaust apertures are disposed upstream from a secondary combustion chamber at least partially defined by the aft liner segment.

The combustor of any preceding clause, wherein at least one of the first exhaust aperture and the second exhaust aperture directs a stream of cooling air to the aft liner segment during operation of the combustor.

A gas turbine engine, comprising: a fan, a compressor section, a combustor section, and a turbine section, the combustor section including a combustor, the combustor comprising: a forward liner segment having an aft end portion, wherein the forward liner segment defines a primary combustion chamber; and an aft liner segment having a forward end portion, wherein the aft liner segment at least partially defines a secondary combustion chamber, wherein a channel is defined between the aft end portion of the forward liner segment and the forward end portion of the aft liner segment, wherein the channel is oriented to direct a stream of dilution air in a counter-flow direction with respect to combustion gases flowing from the primary combustion chamber towards the secondary combustion chamber during operation of the combustor.

The gas turbine engine of any preceding clause, wherein the forward end portion of the aft liner segment is at least partially disposed within the aft end portion of the forward liner segment.

The gas turbine engine of any preceding clause, wherein at least one of the forward liner segment and the aft liner segment defines a plurality of cooling apertures.

The gas turbine engine of any preceding clause, wherein the forward liner segment includes a first damping chamber and a second damping chamber and the aft liner segment comprises a third damping chamber and a fourth damping chamber, wherein each of the first, second, third and fourth damping chambers are disposed downstream from the primary combustion chamber and upstream from the secondary combustion chamber.

The gas turbine engine of any preceding clause, wherein the forward liner segment includes a first damping chamber and a second damping chamber disposed downstream from the primary combustion chamber and upstream from the aft liner segment, wherein the forward liner segment further comprises a first plurality of inlet apertures in fluid communication with the first damping chamber and a second plurality of inlet apertures in fluid communication with the second damping chamber.

The gas turbine engine of any preceding clause, wherein the forward liner segment includes a first exhaust aperture in fluid communication with the first damping chamber and the primary combustion chamber, wherein first exhaust aperture directs a stream of cooling air to the forward liner segment during operation of the combustor.

The gas turbine engine of any preceding clause, wherein the aft liner segment comprises a first damping chamber and a second damping chamber, wherein the first and second damping chambers are disposed downstream from the primary combustion chamber and upstream from the secondary combustion chamber.

The gas turbine engine of any preceding clause, wherein the aft liner segment further comprises a first plurality of inlet apertures in fluid communication with the first damping chamber and a second plurality of inlet apertures in fluid communication with the second damping chamber.

The gas turbine engine of any preceding clause, wherein the aft liner segment includes a first exhaust aperture in fluid communication with the first damping chamber and the primary combustion chamber, and wherein the aft liner segment further includes a second exhaust aperture in fluid communication with the second damping chamber and the primary combustion chamber.

The gas turbine engine of any preceding clause, wherein at least one of the first exhaust aperture and the second exhaust aperture of the aft liner segment directs a stream of cooling air to the aft liner segment during operation of the combustor.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The invention claimed is:

1. A combustor for a gas turbine engine comprising:

a forward liner segment having an aft end portion, wherein the forward liner segment defines a primary combustion chamber; and an aft liner segment having a forward end portion, wherein the forward end portion is disposed within the aft end portion of the forward liner segment, wherein a channel extends radially from an inner surface of the forward liner segment to an outer surface of the aft liner segment, wherein the channel directs a stream of dilution air in a counter-flow direction with respect to combustion gases flowing from the primary combustion chamber during operation of the combustor, wherein one of the forward liner segment or the aft liner segment comprises a first damping chamber and a second damping chamber, wherein the first and second damping chambers are disposed downstream from the primary combustion chamber and upstream from a secondary combustion chamber at least partially defined by the aft liner segment, and wherein a wall partially defines the channel and one of the first damping chamber or the second damping chamber and separates the channel from the one of the first damping chamber or the second damping chamber.

2. The combustor as in claim 1, wherein the forward liner segment comprises the first and second damping chambers and further includes a forward inner liner and a forward outer liner, wherein the forward inner liner at least partially defines the first damping chamber, and the forward outer liner at least partially defines the second damping chamber.

3. The combustor as in claim 1, wherein the forward liner segment comprises the first and second damping chambers, wherein the forward liner segment further comprises a first plurality of inlet apertures in fluid communication with the first damping chamber and a second plurality of inlet apertures in fluid communication with the second damping chamber.

4. The combustor as in claim 3, wherein the forward liner segment includes a first exhaust aperture in fluid communication with the first damping chamber and the primary combustion chamber, and wherein the forward liner segment further includes a second exhaust aperture in fluid communication with the second damping chamber and the primary combustion chamber.

5. The combustor as in claim 4, wherein at least one of the first exhaust aperture and the second exhaust aperture directs a stream of cooling air to the forward liner segment during operation of the combustor.

6. The combustor as in claim 1, wherein the aft liner segment comprises the first and second damping chambers and further includes an aft inner liner and an aft outer liner, wherein the aft inner liner at least partially defines the first damping chamber, and the aft outer liner at least partially defines the second damping chamber.

7. The combustor as in claim 1, wherein the aft liner segment further comprises a first plurality of inlet apertures in fluid communication with the first damping chamber and a second plurality of inlet apertures in fluid communication with the second damping chamber.

8. The combustor as in claim 7, wherein the aft liner segment includes a first exhaust aperture in fluid communication with the first damping chamber, and wherein the aft liner segment includes a second exhaust aperture in fluid communication with the second damping chamber, wherein the first and second exhaust apertures are disposed upstream from the secondary combustion chamber.

9. The combustor as in claim 8, wherein at least one of the first exhaust aperture and the second exhaust aperture directs a stream of cooling air to the aft liner segment during operation of the combustor.

10. A gas turbine engine, comprising:

a fan, a compressor section, a combustor section, and a turbine section, the combustor section including a combustor, the combustor comprising:

a forward liner segment having an aft end portion, wherein the forward liner segment defines a primary combustion chamber; and an aft liner segment having a forward end portion, wherein the forward end portion is disposed within the aft end portion of the forward liner segment, wherein the aft liner segment at least partially defines a secondary combustion chamber, wherein a channel is defined radially from an inner surface of the aft end portion of the forward liner segment to an outer surface the forward end portion of the aft liner segment, wherein the channel is oriented to direct a stream of dilution air in a counter-flow direction with respect to combustion gases flowing from the primary combustion chamber towards the secondary combustion chamber during operation of the combustor, wherein one of the forward liner segment or the aft liner segment comprises a first damping chamber and a second damping chamber, wherein the first and second damping chambers are disposed downstream from the primary combustion chamber and upstream from the secondary combustion chamber, and wherein a wall partially defines the channel and one of the first damping chamber or the second damping chamber and separates the channel from the one of the first damping chamber or the second damping chamber.

11. The gas turbine engine as in claim 10, wherein at least one of the forward liner segment and the aft liner segment defines a plurality of cooling apertures.

12. The gas turbine engine as in claim 10, wherein the other of the forward liner segment or the aft liner segment comprises a third damping chamber and a fourth damping chamber, wherein the third and fourth damping chambers are disposed downstream from the primary combustion chamber and upstream from the secondary combustion chamber.

13. The gas turbine engine as in claim 10, wherein the forward liner segment includes the first damping chamber and the second damping chamber, wherein the forward liner segment further comprises a first plurality of inlet apertures in fluid communication with the first damping chamber and a second plurality of inlet apertures in fluid communication with the second damping chamber.

14. The gas turbine engine as in claim 13, wherein the forward liner segment includes a first exhaust aperture in fluid communication with the first damping chamber and the primary combustion chamber, wherein first exhaust aperture directs a stream of cooling air to the forward liner segment during operation of the combustor.

15. The gas turbine engine as in claim 10, wherein the aft liner segment comprises the first damping chamber and the second damping chamber.

16. The gas turbine engine as in claim 15, wherein the aft liner segment further comprises a first plurality of inlet apertures in fluid communication with the first damping chamber and a second plurality of inlet apertures in fluid communication with the second damping chamber.

17. The gas turbine engine as in claim 16, wherein the aft liner segment includes a first exhaust aperture in fluid communication with the first damping chamber and the primary combustion chamber, and wherein the aft liner segment further includes a second exhaust aperture in fluid communication with the second damping chamber and the primary combustion chamber.

18. The gas turbine engine as in claim 17, wherein at least one of the first exhaust aperture and the second exhaust aperture of the aft liner segment directs a stream of cooling air to the aft liner segment during operation of the combustor.

* * * * *